United States Patent [19]

Sickler

[11] 4,240,615

[45] Dec. 23, 1980

[54] FENCE POST WITH INVERTIBLE SECTIONS

[75] Inventor: Raymond W. Sickler, Wellsburg, N.Y.

[73] Assignee: Dura-Bilt Products, Inc., Wellsburg, N.Y.

[21] Appl. No.: 29,020

[22] Filed: Apr. 11, 1979

[51] Int. Cl.[3] ..... E04H 17/14

[52] U.S. Cl. ..... 256/60; 256/DIG. 5; 403/4

[58] Field of Search ..... 256/DIG. 5, 65, 60, 256/59, 67; 403/160, 4, 3, 363; 52/282, 731, 580

[56] References Cited

U.S. PATENT DOCUMENTS

| | | | |
|---|---|---|---|
| 319,277 | 6/1885 | Lesher | 256/DIG. 5 |
| 776,968 | 12/1904 | Vestal | 256/59 |
| 2,034,709 | 3/1936 | Camp | 256/DIG. 5 |
| 2,669,434 | 2/1954 | White | 256/59 |
| 3,057,601 | 10/1962 | Simpson | 256/59 X |
| 3,108,786 | 10/1963 | Simpson | 256/59 |
| 3,195,864 | 7/1965 | Case | 256/65 |
| 3,728,837 | 4/1973 | Kiefer, Jr. | 256/DIG. 5 |
| 3,738,083 | 6/1973 | Shimano | 52/282 X |

*Primary Examiner*—Andrew V. Kundrat

*Attorney, Agent, or Firm*—Shoemaker and Mattare, Ltd.

[57] ABSTRACT

A fence post comprising male and female members. Each member has a circumferential transverse shape of a portion of a plane geometric figure. A key on the male member is slidingly interlocked with a keyway on the female member to connect the members together. Fence rails are attached together via the fence post, and one of the fence post members can be inverted to alter the orientation of fence rails with respect to each other. Zig-zag fence configurations can thus be defined as easily as straight line fence configurations.

9 Claims, 7 Drawing Figures

FENCE POST WITH INVERTIBLE SECTIONS

BACKGROUND OF THE INVENTION

The present invention relates in general to fences, and, more particularly, to fence posts.

Fences have been used for many years to demark land boundaries, to enclose an area, as decorations, and the like. Accordingly, there are many forms of fence posts available. Examples of such posts are found in U.S. Pat. Nos. 3,108,786, 3,057,601, 3,195,864, 2,034,709, 3,960,367, 4,007,919, 3,955,801 and many other disclosures.

While these known structures are quite useful, they have several drawbacks which prevent the use thereof under a wide variety of conditions. For example, known fence posts are not amenable to easy setup of fences having odd designs, such as zig-zag, or the like. Such odd designs permit demarcation of an unusual land boundary, such as might be defined by a meandering stream, or the like. A decorative garden, or the like, may require an odd fence design. Other uses requiring such odd fence formations will not be detailed, but will occur to those skilled in the art from this disclosure.

A further drawback to presently known fence posts is the inability thereof to provide positive alignment of fence rails under all terrain conditions.

Many known fence posts, especially wood posts, are not amenable to being set up in all types of terrain. The wood posts, especially, are susceptible to rotting and the problems associated with such conditions. Thus, many known fence posts, especially wood posts, may have high maintenance costs which represents a drawback, especially in long fences.

Many known fence posts also have exposed elements which may be sharp and thus dangerous. Such exposed elements also present maintenance problems.

SUMMARY OF THE INVENTION

The fence post embodying the teachings of the present invention is amenable to a very wide variety of fence configurations, is amenable to use in a wide variety of terrains, and has very low maintenance requirements.

The fence post includes a male member having a shape of a semi-circle with a cross-piece located at or near the diameter of the semi-circular member. A key defining element, or male member, is defined centrally on the cross-piece and a pair of rail attaching flanges are integrally attached to the arcuate sections of the male member. In one embodiment, the rail attaching flanges are oriented obliquely with respect to the cross-piece; in another embodiment, the rail attaching flanges are oriented essentially perpendicular to the cross-piece to extend radially outward of the semi-circular male member.

The fence post further includes a semi-circular female member having a cross-piece located at or near the diameter of that member. Keyway defining elements are located centrally of the female member cross-piece, and a pair of rail attaching flanges are integrally attached to the arcuate sections of the female member. The rail attaching flanges are oriented obliquely with respect to the female member cross-piece.

The key of the male member is slidingly engaged in the female element keyway to connect the two members together. In one orientation, the rail attaching flanges are colinear, and by inverting one of the fence post members with respect to the other, the relative orientation of the rail attaching flanges can be changed from coaxial to orthogonal. By using the modified form of the male member, the relative orientation of the rail attaching flanges can be oblique, at 135 degrees apart with the female member in one orientation, and at 225 degrees apart with the female member inverted.

A preferred form of the fence rail is an inverted U-shape, and a circular closure cap is used on the fence post to cover all sharp edges of the post.

OBJECTS OF THE INVENTION

It is, therefore, a main object of the present invention to provide a fence post capable of producing a wide variety of fence configurations.

It is another object of the present invention to provide a fence post amenable to use in a wide variety of terrains.

It is yet another object of the present invention to provide a fence post having low maintenance costs.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
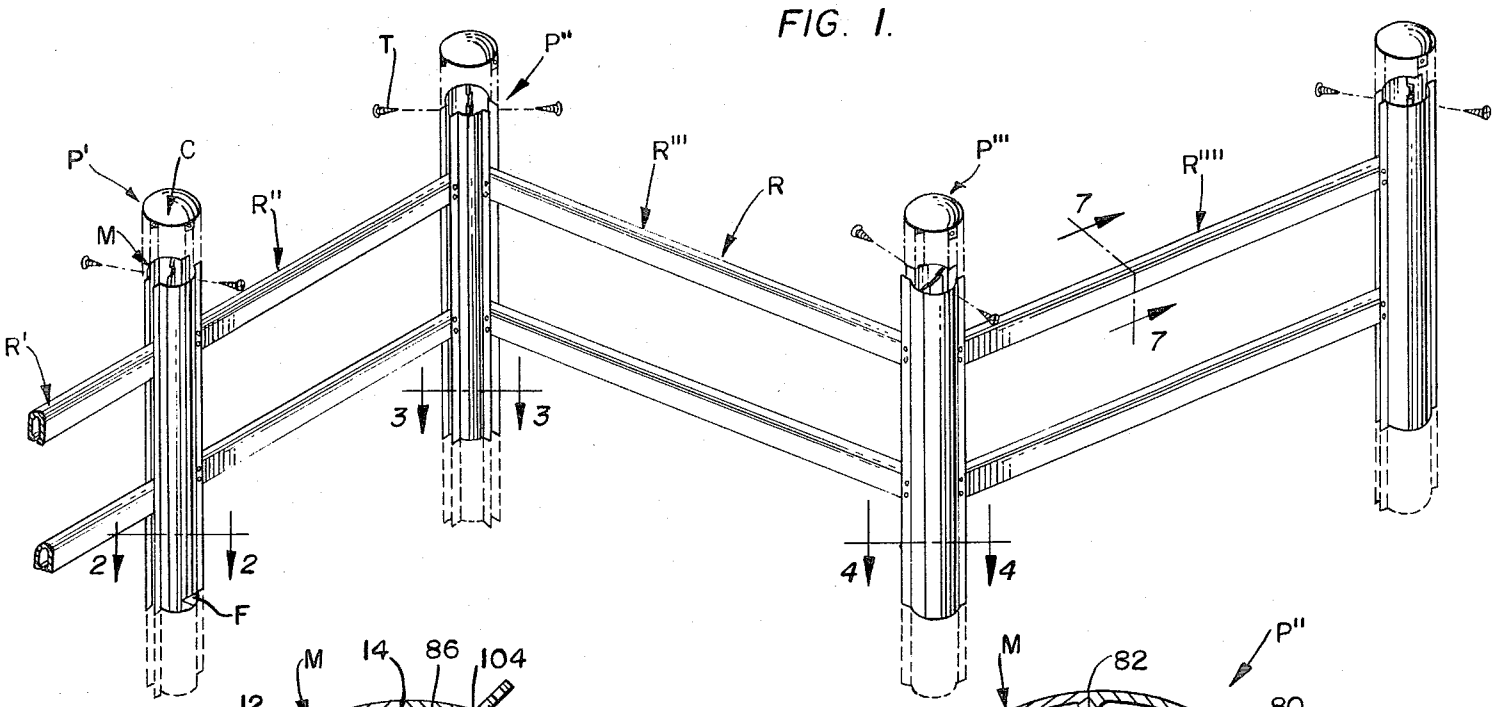
FIG. 1 is a perspective showing a variety of fence configurations produced using the fence post embodying the teachings of the present invention.

Shown in FIG. 1 is a fence set up in a zig-zag configuration to illustrate the orientations possible using the fence post embodying the teachings of the present disclosure. The elongate fence posts are identified in FIG. 1 by the reference indicators P and include paired halves F and M and a top cap C. The posts P are set in a suitable mounting means, such as soil, concrete, or the like, as indicated by the phantom lines in FIG. 1. The paired halves are fastened together in a manner further set forth below, and a plurality of fence rails R are attached to the posts to form the fence. Self-tapping screws T, or the like, can be used to anchor the rails to the posts.

The posts can be formed to orient co-elevational fence rails R′ and R″ in an axially aligned manner (fence post P′), rails R″ and R‴ in an orthogonal manner (fence post P″), or rails R‴ and R⁗ in an oblique manner (fence post P‴). Thus, nearly any fence configuration, from uniform polygons to unusual zig-zag orientations, can be set up easily and quickly.

Figure 3:
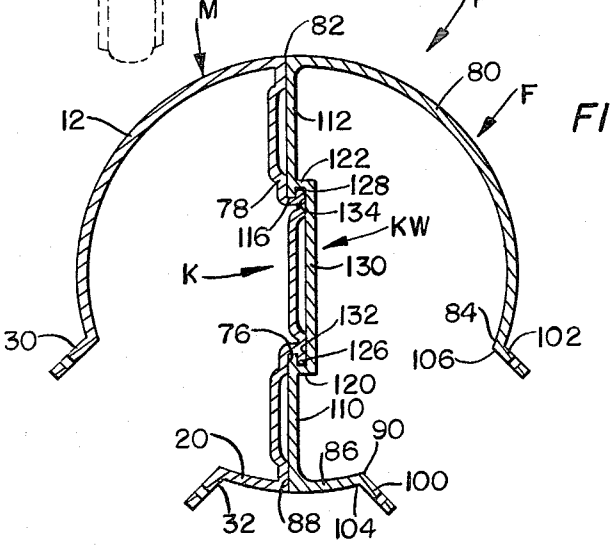
FIG. 3 is a plan view taken along line 3—3 of FIG. 1.
Figure 2:
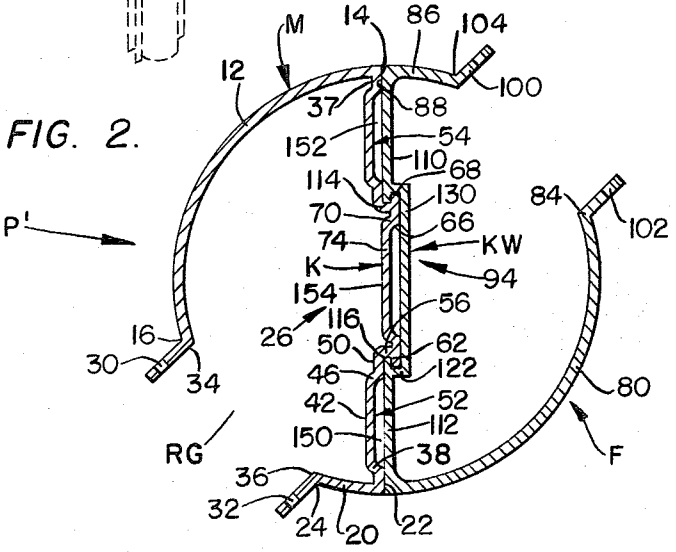
FIG. 2 is a plan view taken along line 2—2 of FIG. 1.

Referring to FIGS. 2 and 3, fence posts P′ and P″ are shown to include a semi-circular male member M and a semi-circular female member F fitting together to define a circular circumferential shape for the fence post.

It is noted that the overall circular circumferential configuration for the transverse shape of the fence posts as indicated in the figures is preferred, but this circumferential shape can correspond to any plane figure without departing from the scope of the present disclosure. Thus, any geometric figure, such as a polygon, or the like, can be used with the male and female members being those portions of such geometric figures which are included in a 180 degree segment thereof as measured from the longitudinal centerline of the fence post. Thus, the preferred members are semi-circular in shape (i.e., each member is that segment of a circle included in an angle of 180 degrees as measured from the post longitudinal centerline), and a square shape for the posts would include male members with three sides of the square, and so forth for other geometric shapes of the transverse cross-sections shown in FIGS. 2, 3 and 4. It is therefore apparent that other configurations can be used by applying the teaching disclosed hereinafter.

The male member is unitary and includes a long arc section 12 having a first edge 14 and a second edge 16, and a short arc section 20 having a first edge 22 and a second edge 24. The arc sections are connected together by a cross-piece 26 integrally connecting the arc first edges together so that the cross-piece lies at or near the diameter of the semi-circle formed by the male member M. A pair of outwardly directed rail attaching flanges 30 and 32 are each integrally attached at the inner edges 34 and 36 thereof to the arc section second edges to be longitudinally disposed on the elongate post section for essentially the entire length of the post. As indicated in FIG. 1, the self-tapping screws T are threaded through the flanges and into the fence rails to attach those rails to the fence posts. Thus, the flanges are in spaced parallelism to define a gap RG therebetween which is sized to accommodate a fence rail in the width upright orientation shown in FIG. 1. The fence post elements are preferably made of metal such as aluminum, or the like, and are extruded. These elements are therefore flexible enough to accommodate a wide range of rail thicknesses without undue distortion.

The cross-piece 26 is bilaterally symmetric and thus includes pairs of those elements which lie off the axial centerline thereof. The cross-piece defines a key defining means K which includes a pair of inwardly directed edge adjacent flats 37, each having one longitudinal edge thereof integrally connected to an arc section first edge and another longitudinal edge thereof connected to one longitudinal edge of a sloping section 38 which slopes inwardly of the male member and which has another longitudinal side edge thereof integrally attached to one longitudinal edge of a planar web section 42 which extends in a direction essentially parallel to the flat 37 but which is offset therefrom. A second slanting section 46 is integrally connected at one longitudinal edge thereof to another longitudinal edge of the planar web section 42 and slopes outwardly of the male member. An inner flat 50 has one longitudinal edge thereof integrally connected to another edge of the planar web section and lies at or near the diametric line defined by the cross-piece 26. The flats and webs thus define trough-like elements 52 and 54 which extend longitudinally of the fence post. An outwardly directed mounting lip 56 extends longitudinally of the post and is oriented to extend perpendicularly outward of the male member M and has the inner longitudinal edge connected to another longitudinal edge of the inner flat 50. As the inner flat 50 lies on or near the diameter of the male member semi-circle, the lip 56 extends outwardly of that semi-circle.

The medial portion of the key K is located on the longitudinal centerline of the male member and includes a pair of channel lips 62 integrally attached to the outer longitudinal edges of the mounting lips to extends in a direction parallel to the cross-piece 26 and to thus be in spaced parallelism with the planar web sections 42. The mounting lips 56 are connected to the channel lips 62 near a longitudinal centerline of those channel lips so the channel lips have the longitudinal side edges 66 and 68 thereof located on opposite sides of the mounting lips. Side edges 66 have elongate wall defining sections 70 integrally attached thereto at one longitudinal edge thereof. The wall defining sections slope inwardly of the male member and are attached together at the inner longitudinal side edges thereof by a planar channel web section 74. The web section 74 is in spaced parallelism with the web section 42. The mounting and channel lips and the inner flats 50 form runner channels 76 and 78, the purpose of which will be described below.

As shown in FIG. 2, the flanges 30 and 32 are oriented obliquely with respect to the cross-piece 26. The purpose of this oblique orientation will be discussed below.

The female member F is shown in FIGS. 2 and 3 to be semi-circular in circumferential shape and to include a long arc section 80 having a first edge 82 and a second edge 84, and a short arc section 86 having a first edge 88 and a second edge 90. The arc sections of the female member, like those of the male member, are connected together by a cross-piece 94 integrally connecting the arc first edges together so that the cross-piece lies at or near the diameter of the semi-circle formed by the unitary female member F. The female member, like the male member, is bilaterally symmetric. A pair of outwardly directed rail attaching flanges 100 and 102 are each integrally attached at the inner edges 104 and 106 thereof to the arc section second edges to be longitudinally disposed on the elongate post section. The self-tapping screws fit through these flanges also as discussed above with regard to the male member.

The female member F includes a keyway defining means KW which includes a pair of planar inwardly directed flanges 110 and 112 which are integrally connected to the female member arc section second edges. The flanges 110 and 112 are coplanar and have inner edges 114 and 116 presented toward each other. A pair of mounting flanges 120 and 122 are attached to the flanges 110 and 112 to be perpendicularly disposed with respect thereto and to thus be in spaced parallelism with each other. The mounting flanges are spaced outwardly from the flange inner edges 114 and 116 to form track defining lips 126 and 128. A planar central web 130 integrally connects the two mounting flanges together and is disposed to be in spaced parallelism with the two flanges 110 and 112 and thus be offset therefrom to define gaps with the lips 126 and 128. These lips, mounting flanges and central web thus define trackways 132 and 134. The gaps defining the trackways are sized to be slightly larger than the thickness of the channel lips 62 of the male member to slidingly receive same as shown in FIGS. 2 and 3. As shown in FIG. 2, the rail mounting frames 100 and 102 are oriented obliquely with respect to the cross-piece 94. The purpose of this oblique orientation will be discussed below.

As shown in the figures, a post is assembled by slidingly interlocking the key of a male member with a keyway of a female member so that the male locking lips 62 are axially registered with the female locking trackways 132 and 134. The offset orientation of the planar webs 42 and 74 define channels 150, 152, and 154 with flanges 110 and 112 and web section 130 respectively.

As shown in FIG. 2, if the long arc of one member is disposed circumferentially adjacent a short arc section of the other member, the rail attaching flanges are axially aligned so that fence rails accommodated thereby are in aligned, colinear relationship with each other. That is, there is 180 degrees between adjacent co-elevational fence rails R′ and R″ which are connected together by the fence post P′.

As shown in FIG. 2, the rail attaching flanges of the two post members are oriented at 45 degree angles with respect to the cross-pieces of those members.

By inverting one of the members F or M, the FIG. 2 coaxial orientation of the rail connecting flanges can be altered to an orthogonal orientation shown in FIG. 3. In the case of FIG. 3, the female member F has been inverted. Thus, to define an orthogonal orientation for adjacent co-elevational fence rails, the post male and female members are oriented with respect to each other so that the long arc section of the male member is circumferentially adjacent the long arc section of the female member, and the short arc sections of the two slidingly interlocked members are also circumferentially adjacent. Thus, using the fence post P″ shown in FIG. 3, the adjacent fence rails R″ and R‴ are oriented at a right angle with respect to each other.

It is noted that while the preferred angular orientation of the rail attaching flanges is 45 degrees with respect to the cross-piece, other angular orientations can also be used without departing from the scope of the present disclosure.

Figure 4:
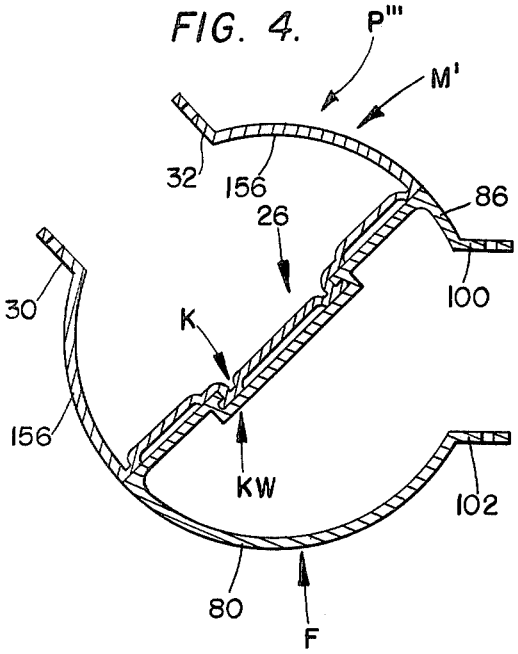
FIG. 4 is a plan view taken along line 4—4 of FIG. 1.

A modified form of the male member is shown in FIG. 4 and denoted by the reference indicator M′. The member M′ has two equal arc sections 156 so that the rail attaching flanges 30 and 32 are radially disposed on the semi-circular member. A fence rail captured between the flanges 30 and 32 is at a right angle with respect to the cross-piece of the male member M′. As shown in FIG. 4, by combining the male member M′ with a female member F, an oblique orientation can be defined by the rail attaching flanges. Thus, the 45 degree orientation of the female member rail attaching flanges with respect to the female member cross-pieces added to the 90 degree orientation of the rail attaching flanges of the male member M′ defines an oblique angle of 135 degrees between two adjacent fence rails R‴ and R⁗. By inverting the FIG. 4 female member, an angle of 225 degrees can be defined between the connected fence rails (or 135 degrees as measured on the other side of those rails). Thus, a zig-zag fence configuration can be easily defined by simply inverting every other fence post female member.

Figure 5:
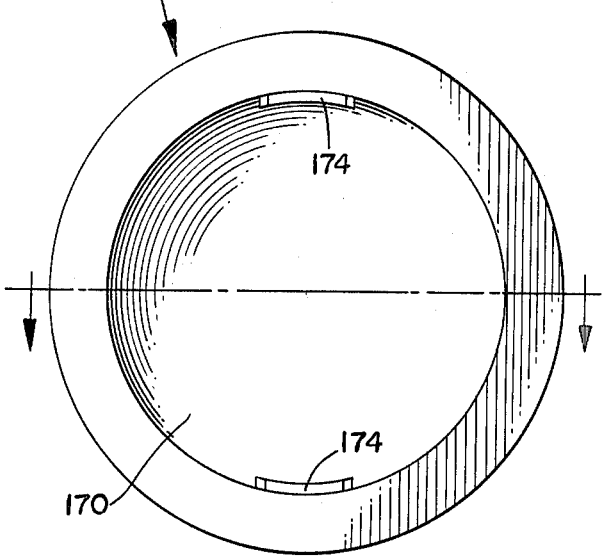
FIG. 5 is a plan view of a post top cap used in the fence post embodying the teachings of the present invention.
Figure 6:
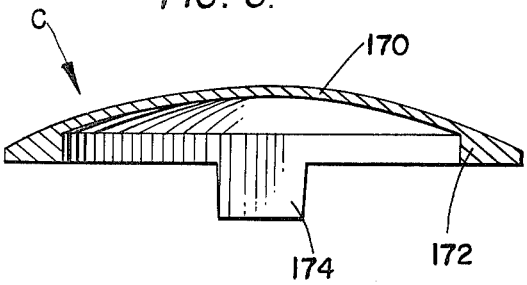
FIG. 6 is a plan view taken along line 6—6 of FIG. 5.

The fence cap C is shown in FIGS. 5 and 6 to be unitary and circular in circumferential shape and to include a concave top section 170 with a depending peripheral skirt section 172 integrally attached thereto. A pair of depending locking ears 174 are integrally attached to the cap at the depending skirt section. As shown in FIG. 5, the ears are arcuate in transverse shape and will snugly fit into the registered fence post members. The cap prevents moisture, dirt, or the like from entering the fence post and thereby inhibiting the cooperable fastening of the male and female members. The cap C is preferably molded plastic.

Figure 7:
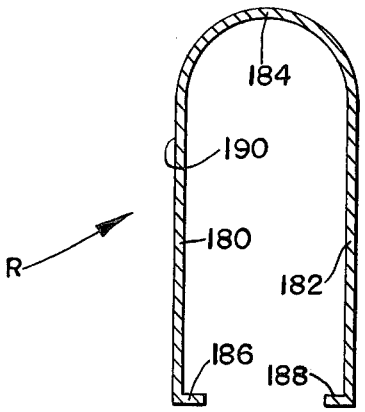
FIG. 7 is a view taken along line 7—7 of FIG. 1.

A fence rail is shown in FIG. 7 and is an inverted U-shape with a pair of parallel legs 180 and 182 integrally connected together by a bight section 184. The legs have inturned flanges 186 and 188 on the free ends thereof. The outer surface 190 of the fence rail contacts the inner surfaces of the rail attaching flanges and the outer surface of the bight section is presented upwardly in the set up fence as indicated in FIG. 7. Preferably, the fence rails are aluminum. The cap shown in FIGS. 5 and 6 and the fence rail shown in FIG. 7 are preferred, but other shapes and types can be used without departing from the scope of the present disclosure. For example, standard two-by-four or two-by-six lumber may be used in place of the preferred aluminum fence rails. Preferably, the fence posts fence rails have baked acrylic enamel finishes.

As can be seen from the foregoing, the fence rails can be attached to the fence posts at any suitable height and spacing as the rail attaching flanges extend for essentially the entire length of the fence posts. Furthermore, rails can be easily replaced by simply backing out the appropriate screws, removing a fence rail, and replacing that rail with a new rail. The rail attaching flanges thus provide a great deal of versatility to the fence posts P.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A fence post comprising:

an elongate male member having a transverse outer peripheral shape of about one-half of a plane figure and a cross-piece defining one side of said male member, said male member including a key defining means extending longitudinally of said male member on said cross-piece near the longitudinal center of said cross-piece and rail attaching means on said male member; and an elongate female member connected to said male member and having a transverse outer peripheral shape of about one-half of a plane figure and a female cross-piece defining one side of said female member, said female member including a keyway defining means extending longitudinally of said female member on said female cross-piece near the longitudinal centerline of said female cross-piece, and rail attaching means on said female member, said male key defining means slidingly engaging said female keyway defining means to attach said members together, said rail attaching means being oriented obliquely with respect to said cross-pieces.

2. The fence post of claim 1 further including a cap on said engaged members.

3. The fence post of claim 1 further including a rail connected to said male and female rail attaching means.

4. The fence post of claim 3 wherein said rail is U-shaped.

5. The fence post of claim 1 wherein the angle between said rail attaching means is about 135 degrees.

6. The fence post of claim 1 wherein said rail attaching means extend for essentially the entire length of said post members.

7. The fence post of claim 1 wherein said transverse outer peripheral shape is semi-circular and said cross-pieces lie near the diameter of said semi-circular members.

8. The fence post of claim 7 wherein said key defining portion includes a first planar edge member connected at one edge to the outer peripheral portion of said male member, a first slanting wall connected at one edge thereof to another edge of said edge member, a planar web connected at one edge to another edge of said first slanting member, a second slanting wall connected at one edge to another edge of said web, a planar inner flange connected at one edge to another edge of said second slanting wall, a mounting lip connected at one edge to another edge of said inner flange to be oriented essentially perpendicularly thereto, a second lip connected to another edge of said mounting lip and oriented to be essentially coplanar with said web.

9. The fence post of claim 8 wherein said keyway defining portion includes a first flange extending along a diameter of said female member, a mounting flange attached to said keyway first flange at a location spaced from an inner edge of said keyway first flange and oriented to be essentially perpendicular with said keyway first flange, and a web section connected to said mounting flange.

* * * * *